United States Patent [19]

Papst et al.

[11] Patent Number: 4,618,315

[45] Date of Patent: Oct. 21, 1986

[54] SMALL FAN

[75] Inventors: Georg Papst, St. Georgen; Günter Wrobel, Villingen-Schwenningen, both of Fed. Rep. of Germany

[73] Assignee: Papst-Motoren GmbH & Co., St. Georgen, Fed. Rep. of Germany

[21] Appl. No.: 694,912

[22] Filed: Jan. 28, 1985

Related U.S. Application Data

[63] Continuation of Ser. No. 382,247, May 26, 1982, abandoned.

[30] Foreign Application Priority Data

May 29, 1981 [CH] Switzerland ..... 3520/81

[51] Int. Cl.[4] ..... F04B 35/04; F04D 29/02

[52] U.S. Cl. ..... 417/354; 417/360; 417/423 R; 415/213 C; 415/215

[58] Field of Search ..... 417/354, 353, 352, 360, 417/423 R; 416/215, 218; 415/212 R, 213 R, 213 C, 215, 219 R

[56] References Cited

U.S. PATENT DOCUMENTS

| | | | |
|---|---|---|---|
| 1,614,091 | 1/1927 | Van Toff | 415/215 |
| 2,665,054 | 1/1954 | Fischer | 417/360 |
| 2,809,801 | 10/1957 | Curry | 416/218 |
| 2,926,838 | 3/1960 | Van Rign | 417/354 |
| 3,246,999 | 4/1966 | Jocz | 416/215 |
| 3,515,498 | 9/1968 | Tomita | 415/182 |
| 3,531,221 | 9/1970 | Herberg et al. | 415/213 R |
| 3,961,864 | 6/1976 | Papst et al. | 417/354 |
| 4,371,313 | 2/1983 | Burghacher et al. | 415/215 |

FOREIGN PATENT DOCUMENTS

| | | | |
|---|---|---|---|
| 1031929 | 2/1955 | Fed. Rep. of Germany | 417/354 |

*Primary Examiner*—Cornelius J. Husar
*Assistant Examiner*—Peter M. Cuomo
*Attorney, Agent, or Firm*—Fitch, Even, Tabin & Flannery

[57] ABSTRACT

A small fan with an electric power motor is provided, the rotor of which is designed as a cup-shaped outer rotor and blade wheel hub. The outer wall of the blade wheel hub coaxially widens in the direction of air flow and forms the inner wall of an air flow duct. The fan blades are mounted on this outer wall, which wall, is conical shaped and is disposed as an outer lining over the cup-shaped outer rotor.

9 Claims, 7 Drawing Figures

SMALL FAN

This application is a continuation of application Ser. No. 382,247 filed May 26, 1982, abandoned.

The invention relates to a small fan having an electrical power motor. The motor includes a rotor in the form of a cup-shaped outer rotor mounting a blade wheel hub. The fan housing includes an outer wall coaxially widening in the direction of air flow, and the blade wheel provides an inner wall mounting the blades and also coaxially widening in the direction of air flow. The inner and outer walls define an air flow duct therebetween.

The air duct in such small fans is annular, and the duct as a whole widens in inverted funnel-like or conical shape in the direction of air flow. Because the air does not flow purely radially or purely axially, but is drawn or sucked in axially and discharged with a strong radial component, such fans generally are called diagonal fans. In such fans the motor rotor can be formed of a cast composition, its jacket taking the desired conical shape. But this calls for a considerable amount of casting material and requires an unnecessary increase in inertia.

It is an object of the invention to form the desired inner wall of the flow duct with as little material as possible, which, among other things, will simplify the manufacturing of the fan.

Other objects and advantages of the invention will become apparent from the following detailed description taken in connection with the accompanying drawings, wherein.

Figure 1:
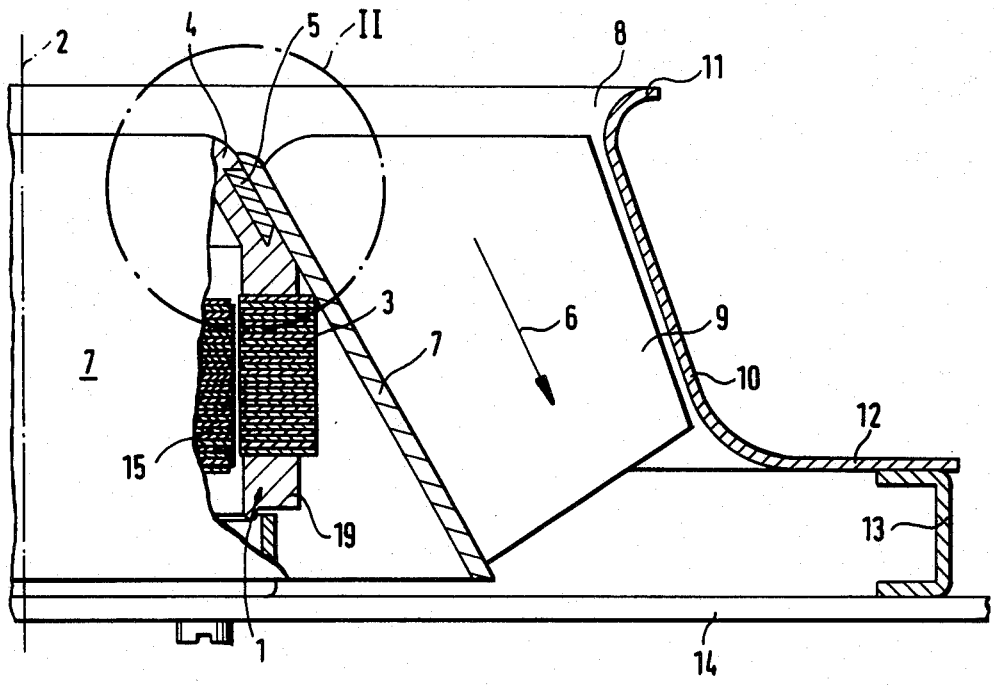
FIG. 1 is a partial cross section of the right half of a first embodiment of a fan in accordance with the invention.

Briefly, the invention is characterized in that the inner wall is formed by a conical-shaped member which is mounted around the motor rotor as an outer lining and is mounted on the motor rotor with fastening means engaging the intake or suction end of the member and the motor rotor.

According to the invention, the conical member relates to the motor rotor like a collar and encloses an empty or dead space to form an unused annular space immediately around the motor rotor. Thus, the significance is in the air duct formed outwardly of the conical member and not inwardly thereof, the inward space replacing the cast material.

Such a conical member can be simply prepared of sheet metal or plastic. It can be provided in advance with blades and be mounted on the motor rotor together with the blades as a unitized structural member. A single molded plastic part is recommended in instances when both the conical member and the blades are made of plastic.

This conical member can be very simply secured to the motor rotor. A preferred embodiment of the invention is characterized by a hub head of the motor rotor on the intake or suction side being formed as a closed lining and being fastened to the lamination stack. More particularly, an embodiment is recommended where the hub head is of cast lightweight metal and projections are affixed to the inside surface of the conical member as fastening means. The projections have a dovetailed cross section and are embedded in the lightweight metal of the hub head; or where the hub head is of lightweight metal and as fastening means iron rings are provided which are embedded in the lightweight metal of the hub head so that they still extend flush with the surface, and the conical member is made of sheet metal and is welded to these iron rings.

In manufacturing the motor rotor, it is necessary to insert the lamination stack of the squirrel cage into the squirrel cage housing which forms the motor rotor in such a small fan having an a.c. motor. The conical member can be secured at the same time in accordance with an expedient embodiment of the invention. Such further embodiment is characterized by the conical member at its narrower end being bent inwardly to form a ring extending in a radial plane, the ring being held between the lamination stack and the hub head or being mounted to overlie the front side of the hub head facing the intake or suction side.

Another embodiment of the invention is recommended for the conical member, whether injection molded or cast, and is characterized by a coaxial tube section being rigidly fit over the lamination stack of the rotor and the conical member, extending from a narrower end to a wider end, being interlocked therewith at the narrower end to rigidly fit on the motor rotor. In this embodiment, the conical member can be made to be form fitted on the motor rotor to produce a sufficiently rigid seating, eliminating the need for other fastening means. Additional fastening means can be provided, for example, by forming corrugations in the rotor material and a complementary form in adjacent portion of the conical member to secure the conical member, or by disposing in the annular interspace between the conical member and the tubular section radially extending support walls distributed around the circumference and utilizing the free edges of these support walls as mounting surfaces. The support walls are supported on the side of the lamination stack opposite the hub head. Another alternative is to provide projections on the free edges of the support walls and a metal spring retainer with barbs being stuck into each of these projections, such retainers at one end bearing against a corresponding free edge of each of the radial walls and at their other end on the discharge side of the lamination stack. The springs also can be fastened with screws or the like rather than by barbs mounted on the projections.

More particularly and referring first to FIG. 1, a motor rotor 1 has an axis 2 which coincides with the axis of the fan. The rotor 1 is preferably of a cast aluminum structure forming a squirrel cage housing 19, into which is introduced a lamination stack 3. A part of the aluminum structure forms a hub head 4. In the hub head 4 are partly embedded lugs 5 distributed around the periphery. These lugs 5 are of dovetailed cross section and are affixed interiorly of the narrower end of a conical or inverted funnel-shaped member 7 which widens in the direction of air flow as indicated by an arrow 6. The conical member 7 forms the inner wall of an air duct 8 and thus is mounted on the motor rotor 1. In this illustrated embodiment, a total of seven fan blades are mounted on the conical member 7 and are distributed around the circumference. The air duct 8 is limited on its outside by the stationary outer wall 10 which likewise conically widens in the air flow direction indicated by the arrow 6. At the suction side facing the flow, the wall 10 has an outwardly turned flange 11, and at the pressure side end terminates in a ring 12 which extends in a radial plane. The ring 12 is mounted on a base 14 via U-members 13 distributed around the circumference. A stator 15 of the electrical power motor is also mounted on this base 14. The air follows the path through the air duct 8 as indicated by the arrow 6 from the suction or intake end of the duct and is discharged radially and parallel with the base 14.

Figure 2:
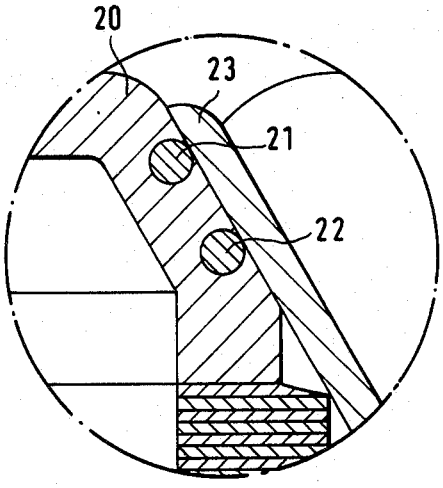
FIG. 2 shows a modification of a portion of the fan of FIG. 1 as defined by the broken line II.

Lugs corresponding to the lugs 5 are absent in the modified structure shown in FIG. 2. Instead of the lugs, iron rings 21, 22 coaxial with the fan axis are embedded in the hub head 20. These rings are tangentially flush with the surface of the hub head and are affixed, for example, by welding, to a conical member 23 corresponding to the conical member 7 in FIG. 1. The conical member in this embodiment is preferably of sheet metal. Otherwise, the embodiment of FIG. 2 is the same as the embodiment of FIG. 1.

Figure 3:
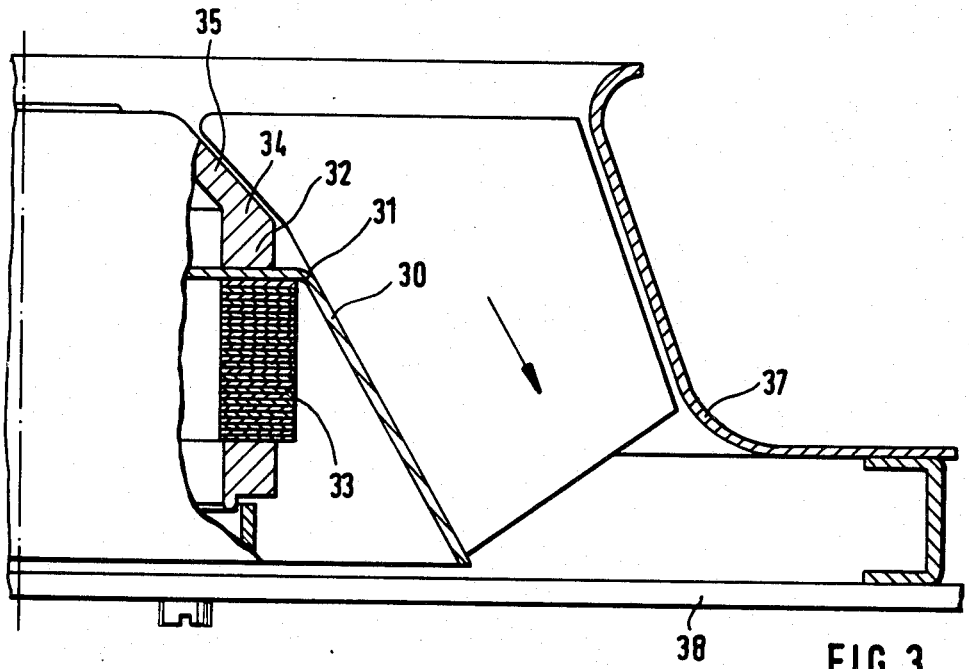
FIGS. 3 to 7 show other embodiments of the fan of FIG. 1.

The embodiment of FIG. 3 differs from the embodiment of FIG. 1 by the special configuration and mounting of the conical member 30 corresponding to the conical member 7 in FIG. 1. The member 30 is bent at its narrower end 31 to a radial ring 32, which is disposed between the lamination stack 33 and the hub head 34 of the motor rotor 35. The blades mounted on the conical member 30 extend beyond the narrow end 31 of the conical member into the suction end of the hub opposite the pressure side. Otherwise, this embodiment is of the same construction as the one of FIG. 1. The outer wall of the air duct corresponding to the outer wall 10 is designated as 37, and the base corresponding to the base 14 is designated as 38.

Figure 4:
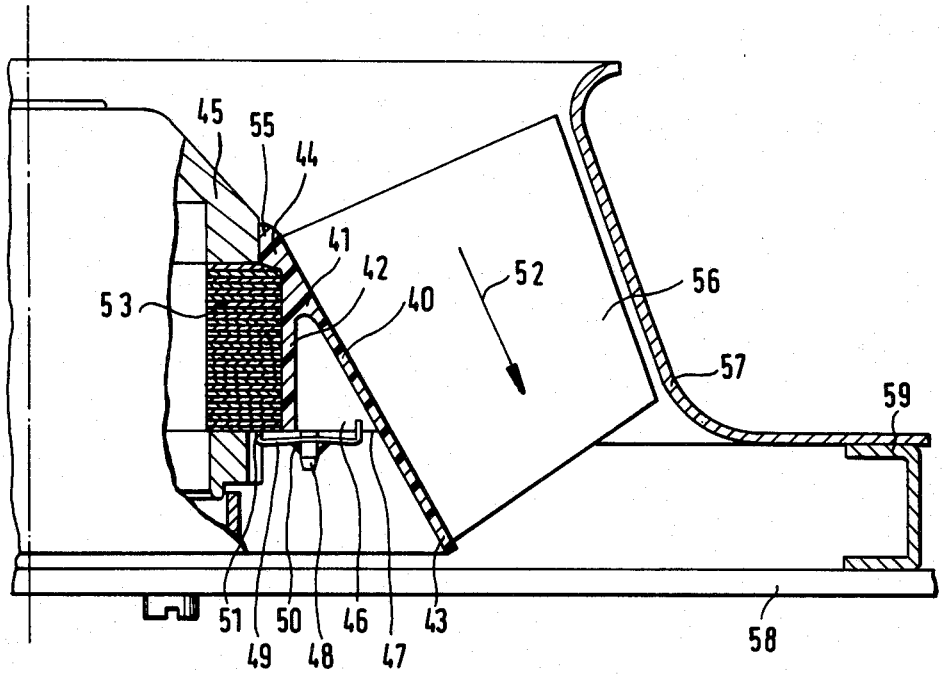

The conical member 40 in FIG. 4 is preferably of plastic and is provided at its narrow end 41 with a tube section 42, which extends to the wider end 43. The inner contour 44 of the conical member 40 or of the tube section 42 is adapted to the outer contour of the motor rotor 45. The conical member 40 with the tube section is tightly applied as a cover on the motor rotor, for example by form fitting. Radial support walls 46 are distributed on the circumference and extend in the ring duct between the conical member 40 and tube section 42. At least one of the support walls has an integral pin-like projection 48 on which is disposed a metal spring-type retainer, which with a pair of barbs 50 clasps the projection 48 and secures its position against withdrawal. The retainer is springingly supported on both its ends as can be seen in FIG. 4. One end bears against the free edge 47 of the support wall 46, and the other end 51 bears against the discharge side of the lamination stack 53. Thus, in conjunction with the edge 55 of the conical member over extending on the suction side of the lamination stack, the conical member is securely mounted on the rotor. The fan blades 56 are mounted on the outer surface of the conical member the same as in the other embodiments. The outer wall corresponding to the outer wall 10 of the air duct (FIG. 1) is designated No. 57. The base corresponding to the base 14 is No. 58, and a support corresponding to the U-shaped support 13 is No. 59.

Figure 5:
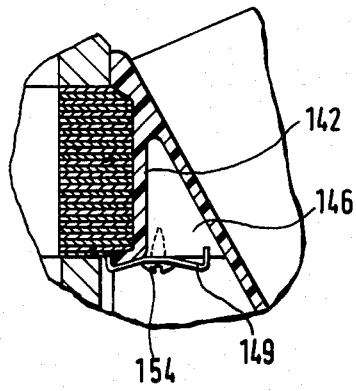

In the embodiment of FIG. 5, a spring retainer 149 corresponding in position to the retainer 49 if FIG. 4 is secured by a screw 154 into the edge of the support wall 146. A projection corresponding to projection 48 is not provided in the embodiment of FIG. 5. Otherwise, the embodiment of FIG. 5 is of the same construction as the embodiment of FIG. 4, and the corresponding parts are designated by the same reference number, but increased by 100 in FIG. 5.

Figure 6:
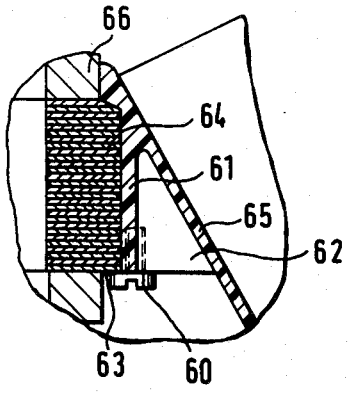

The embodiment of FIG. 6 differs from the embodiment of FIG. 4 in that instead of the spring retainer and the projection 48, a screw 60 having a wide head is screwed from the open side into the function of the tube section 61 and a support wall 62. The head of this screw captures the conical member 65 against the rearward side 63 of the lamination stack 64 and thereby holds the conical member 65 on the motor rotor 66. Otherwise, the embodiment of FIG. 6 is of the same construction as the embodiment of FIG. 4.

Figure 7:
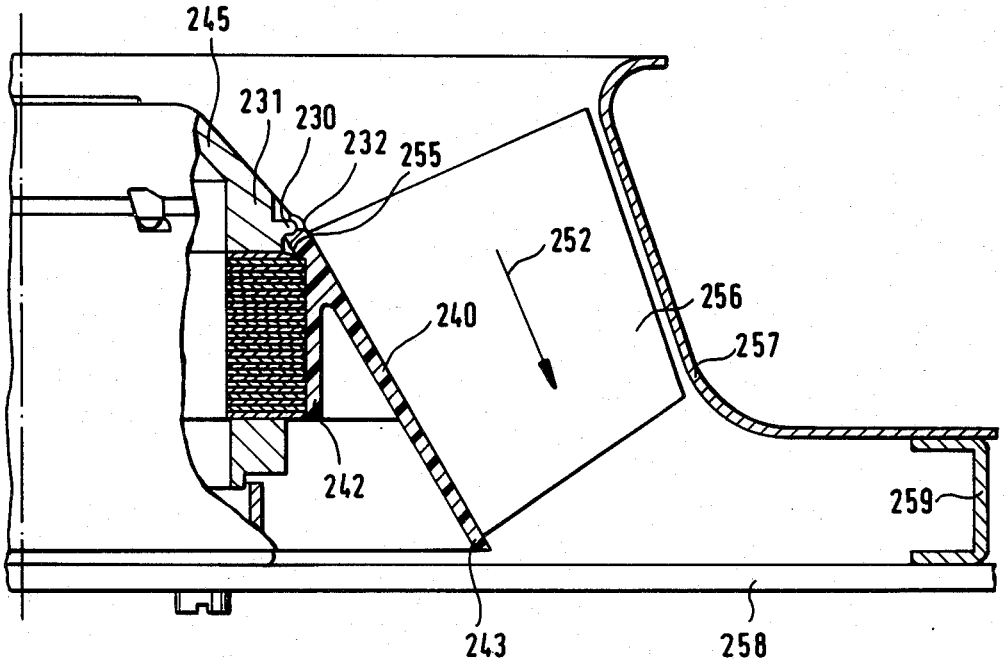

In the embodiment of FIG. 7, of the conical member 240 an edge 255 on the suction side and corresponding to the conical member of FIG. 4 is secured by corrugations 230 distributed around the circumference. These corrugations are pressed or otherwise formed in from the soft aluminum material of the cage housing 231 of the motor rotor 245. A recess 232 is provided in the edge 255 of the upper end of the conical member 240 for each of the corrugations, a corresponding corrugation fitting into a recess. Otherwise, the embodiment of FIG. 7 is the same as the embodiment of FIG. 4. Corresponding members are designated by the same reference numbers, but increased by 200 in FIG. 7.

Thus, there has been provided in accordance with the invention, a small fan of the outer rotor motor type having a structure that provides a conically directed air duct through the fan blades without a massive rotor having otherwise high inertia. The conically shaped inner wall of the air duct is formed and mounted securely on the rotor in various embodiments shown and described herein.

It is recognized that the invention may be susceptible to various other modifications and alternative constructions in view of this disclosure. Although the invention has been shown and described in detail herein by a preferred embodiment and certain alternatives, it is understood that there is no intention of limiting the invention strictly to this disclosure, but rather it is the intention to cover all such modifications and alternative constructions falling within the spirit and scope of the invention as defined in the appended claims.

What is claimed is:

1. A small electric motor fan having an air discharge side and an air suction side, comprising:

a housing having an outer wall conically widening in the direction of air flow;

a cup-shaped outer rotor, said rotor having an integral conically narrowed portion facing outwardly towrad the incoming air on the air suction side of said fan, said rotor being in the form a squirrel cage housing and including a squirrel cage lamination stack;

a conical member being generally hollow and having an inner surface and an outer surface, said conical member being separate from but mounted on said rotor around at least a portion of the periphery thereof for rotation coaxially therewith and formed and mounted in such manner that no portion thereof extends onto or pierces the radial plane of the portion of the rotor that faces outwardly toward the incoming air on the air suction side of said fan, said conical member widening coaxially in the direction of air flow, the outer surface of said conical member and the outer wall of said housing defining therebetween a conically directed air flow duct, said conical member further defining a dead space inwardly of its wide end between said member and said rotor;

fastening means engaging said conical member to said rotor; and a plurality of blades mounted on the outer surface of said conical member in the air flow duct.

2. A small fan according to claim 1 wherein said rotor is of cast lightweight metal and said conical member fastening means includes projections on the inside of said conical member, said projections having a dovetailed cross section and being embedded in the conically narrowed portion on the suction end of the rotor.

3. A small fan according to claim 1 wherein said rotor is of cast lightweight metal and said conical member fastening means includes a plurality of iron rings embedded in the conically narrowed portion of lightweight metal on the suction end of the rotor tangentially flush with the surface thereof and wherein said conical member is of sheet metal and is welded to said iron rings.

4. A small fan according to claim 1, wherein said conical member merges at its narrow end into a ring extending in a radial plane, said ring fastening said conical member by being enclosed between the lamination stack and the hub head, the plurality of blades also extending axially adjacent the periphery of the conically narrowed portion of said rotor.

5. A small fan according to claim 1, wherein said conical member includes an inner tube section tightly fitting over the periphery of the lamination stack, said tube section together with the narrower end of said conical member forming a unitary structure and including further means for fastening the unitary structure on said rotor.

6. A small fan according to claim 5, further including radially extending support walls spaced on the outer circumference of said tube section between the inner surface of said conical member and the tube section and wherein said unitary structure fastening means includes projections extending axially from the free edges of said support walls; spring retaining means unidirectionally lockable on said projections, said spring retaining means extending across a portion of the free edges of said support walls and a portion of the lamination stack adjacent its periphery on the air discharge side; and an over extending head of said unitary structure in gripping relation with a portion of the lamination stack adjacent its periphery on the air suction side.

7. A small fan according to claim 5, further including radially extending support walls spaced on the outer circumference of said tube section between the inner surface of said conical member and the tube section and wherein said unitary structure fastening means includes screws inserted into free edges of said support walls; retaining means secured by said screws, said retaining means extending across a portion of the free edges of said support walls and a portion of the lamination stack adjacent its periphery on the air discharge side; and an over extending head of said unitary structure in gripping relation with a portion of the lamination stack adjacent its periphery on the air suction side.

8. A small fan according to claim 5, further including radially extending support walls spaced on the outer circumference of said tube section between the inner surface of said conical member and the tube section and wherein said unitary structure fastening means includes screws inserted into free edges of said support walls, said screws having heads also extending across a portion of the lamination stack adjacent its periphery on the air discharge side; and an over extending head of said unitary structure in gripping relation with a portion of the lamination stack adjacent its periphery on the air suction side.

9. A small fan according to claim 6, wherein said conical member is secured on said rotor by a stiffening corrugation provided in the material of the rotor distributed on the circumference of the rotor and interlocked with a complementary form in the head of said unitary structure.

* * * * *

UNITED STATES PATENT AND TRADEMARK OFFICE

CERTIFICATE OF CORRECTION

PATENT NO. : 4,618,315

DATED : October 21, 1986

INVENTOR(S) : Papst et al.

It is certified that error appears in the above-identified patent and that said Letters Patent is hereby corrected as shown below:

Face of Patent, ASSIGNEE, after "Co." insert --KG--.

Figure 8:
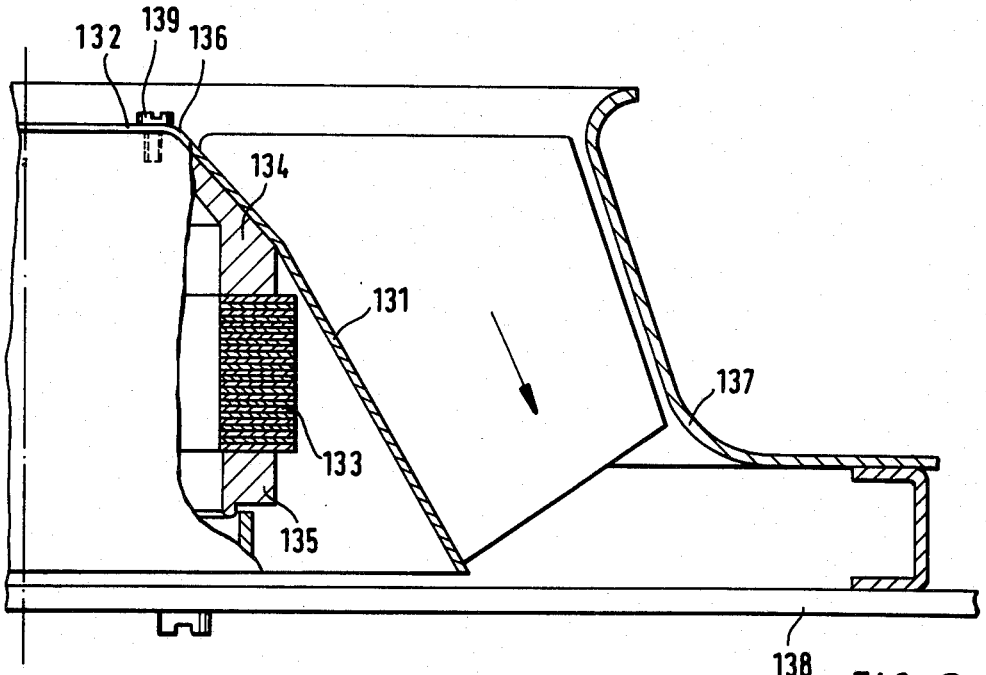

DRAWINGS, Sheet 5/5, delete "FIG. 8".

Col. 4, Line 51, change "towrad" to --toward--.

Signed and Sealed this

Fourteenth Day of April, 1987

*Attest:*

DONALD J. QUIGG

*Attesting Officer*

*Commissioner of Patents and Trademarks*